United States Patent [19]

Ward, Jr. et al.

[11] 4,034,321

[45] July 5, 1977

[54] METHOD AND APPARATUS FOR MICROSTRIP TERMINATION

[75] Inventors: James H. Ward, Jr.; Max W. Medley, Jr., both of Largo, Fla.

[73] Assignee: E-Systems, Inc., Dallas, Tex.

[22] Filed: Apr. 15, 1976

[21] Appl. No.: 677,343

[52] U.S. Cl. ..... 333/84 M; 333/34

[51] Int. Cl.[2] ..... H01P 1/24

[58] Field of Search ..... 333/22 R, 35, 73 S, 333/81 A, 84 M, 33, 34, 24.2

[56] References Cited

UNITED STATES PATENTS

| | | | |
|---|---|---|---|
| 3,289,112 | 11/1966 | Brown | 333/24.2 |
| 3,422,377 | 1/1969 | Vient | 333/35 X |
| 3,585,533 | 6/1971 | Denhard | 333/22 R |
| 3,886,502 | 5/1975 | Radding et al. | 333/22 R X |

*Primary Examiner*—Paul L. Gensler
*Attorney, Agent, or Firm*—Robert V. Wilder

[57] ABSTRACT

The characteristic impedance of a planar microstrip or stripline for transmitting signals along a transmission line in the TEM mode is matched by way of a tapered shunt which terminates the line in a dc short circuit to ground. The tapered shunt or termination wraps around the edge of the insulating substrate and electrically connects the microstrip to the ground plane. The geometry of the tapered shunt is incrementally adjusted by means of a series of steps to produce a termination having a selected impedance.

12 Claims, 2 Drawing Figures

METHOD AND APPARATUS FOR MICROSTRIP TERMINATION

BACKGROUND OF THE INVENTION

This invention was developed during work done under contract, or subcontract arising therefrom, to the Department of the Navy.

This invention relates to impedance matching of microstrips or strip transmission lines, and to the termination of a microstrip and/or stripline having a known characteristic impedance.

More particularly, the invention relates to an improved short-circuit termination for a microstrip and/or stripline transmission line.

To prevent wave reflection and undesirable standing waves on a transmission line carrying high frequency components, the characteristic impedance of the line must be matched at points of discontinuity, especially at termination points. Impedance matching is essential to the transmission of TEM mode signals of microwave frequencies and is commonly accomplished by terminating the transmission line with an impedance which equals the characteristic impedance of the line itself. When a transmission line is in the form of a microstrip, proper termination in a mechanically acceptable manner, and in a manner which is adaptable to mass production techniques, is an extremely difficult problem. Typically, a microstrip line refers to a conductor on one surface of an insulating substrate, while stripline refers to a pair of conductors, one on each side of an insulating substrate.

The termination of microstrip transmission lines is typically accomplished by using a stub of known impedance and adding a grounding strap or by drilling a hole through both the microstrip and the insulating substrate and thereafter inserting a conductive plug having the desired impedance characteristics. The inserted plug contacts both the microstrip at one surface of the substrate and the ground plane at the opposite surface of the substrate. Termination techniques requiring holes through the substrate involve serious mechanical and electrical difficulties and shortcomings. The formation of holes, particularly at the edges of the substrate where terminations typically occur, serves to weaken the structural integrity of the substrate. It is also difficult to control tolerances due to variations in the hole dimensions and variations in the registration of the mask used to either photo-etch or vapor deposit the microstrip configuration on the substrate. The additional fabrication processes required in drilling holes through the substrate (which is frequently alumina), to achieve prior art termination schemes and the installation of grounding strips or plugs serve to significantly increase the cost of fabricating microstrip systems such as those encountered in planar computer memories.

Electrically, the ground connection obtained either by a ground strap or by a conductive plug introduces significant and undesirable inductive components. Further, the presence of a hole through the substrate produces a discontinuity which locally distorts the electric field distribution between the microstrip and the ground plane. The discontinuities produced by holes or ground strips act to generate undesirable circuit parasitics; and, because of the lower effective Q value which results, transmission lines losses increase.

Microstrips are also commonly terminated by connecting the signal transmission line to a shunted stub. The shunt, which is grounded, connects at a T junction. But, such a connection cannot be considered merely a direct junction since the power stored in the neighborhood of the junction creates a reactive effect. Additional, a T junction, as any other irregularity in transmission line width, introduces significant discontinuity effects. It is only necessary to understand that such discontinuites are undesirable to appreciate the contribution of the present invention. However, the problem of the discontinuity introduced by a sudden change in linewidth is discussed more fully in A. Farrar and A. T. Adams, "Matrix Methods for Microstrip Three Dimensional Problems", IEEE Transactions on Microwave Theory and Techniques, Vol. MTT-20, No. 8, p. 497, August 1972, while the problem of T junction discontinuities is more fully discussed in R. W. Vogel, "Effects of the T-Junction Discontinuity in the design of Microstrip Directional Coupler", IEEE Transactions on Microstrip Theory and Techniques, p. 145, March 1973.

It is an object of the present invention to provide a method and apparatus for terminating a microstrip without impairing the structural integrity of a substrate on which the microstrip is located.

It is also an object of the present invention to provide a method and apparatus for grounding microstrips without introducing excessive series inductance.

It is another object of the present invention to provide a method and apparatus for grounding transmission lines without introducing undesirable discontinuities at T junctions, at points of irregular linewidth or points of sudden change in linewidth.

It is another object of the present invention to provide a method and apparatus for providing an improved short-circuit termination for microstrips, stripline circuits and related devices operating in the TEM mode.

It is another object of the present invention to provide a method and apparatus for grounding transmission line stubs without increasing the effective T junction capacity.

It is a further object of the present invention to provide a method and apparatus for grounding transmission lines while permitting the shunt impedance of the termination to be readily and selectively altered.

Yet another object of the present invention is to provide a method and apparatus for grounding microstrip transmission lines without introducing appreciable transmission loss.

It is a further object of the present invention to provide a method and apparatus for grounding microstrip transmission lines at low cost and with high manufacturing reliability.

These and other objects and features of the present invention will become apparent upon reading the following detailed description of a preferred embodiment of the invention, together with the accompanying drawing.

SUMMARY OF THE INVENTION

Briefly stated, and in accordance with a preferred embodiment of the present invention, a planar microstrip transmission line for carrying high frequency TEM mode signals is impedance matched with a shunted transmission line. The shunt line is a step tapered stub which wraps around the edge of the substrate for connection to the microstrip ground plane. The tapered stub geometric configuration is particularly advantageous in providing an easily fabricated short-circuit termination connected to the microstrip ground plane for operation at the intended high frequencies.

DETAILED DESCRIPTION OF THE ILLUSTRATIVE EMBODIMENT

Figure 1:
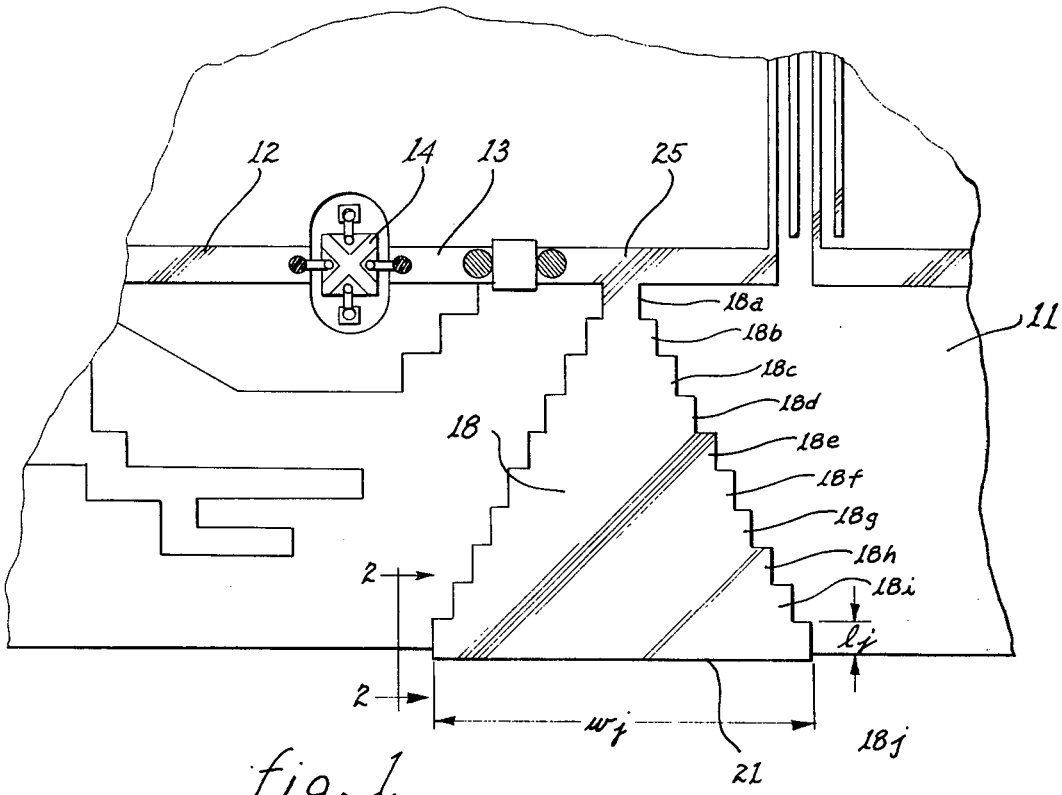
FIG. 1 is a fragmentary plan view of a microstrip substrate with a shunted transmission path embodying the present invention.

A portion of a planar substrate microcircuit, including a microstrip transmission line of operation in the TEM mode at microwave frequencies is shown in FIG. 1. The transmission line is shunted to ground in accordance with the present invention. Substrate 11 includes thereon an input transmission line 12 and an output transmission line 13. Connected between input line 12 and output line 13 is a transistor 14 which provides signal amplification.

Generally, the input impedance, $Z_{IN}$ of a lossless transmission line terminating in an arbitrary impedance is given by the following equation:

$$Z_{IN} = Z_O \left[ \frac{Z_{RL} + {}_jZ_O \tan(\beta l)}{Z_O + {}_jZ_{RL} \tan(\beta l)} \right] \quad (1)$$

where $Z_O$ is the characteristic impedance of the line $Z_{RL}$ is the termination impedance $\beta$ is the propagation constant and is equal to $2\pi/$ , where is the approximate signal wavelength $l$ is the length of the transmission segment When the transmission line is short circuited to ground, $Z_{RL} = 0.0 + j0.0$ and equation (1) becomes:

$$Z_{RL} = j\, Z_O \tan(\beta l) \quad (2)$$

Figure 2:
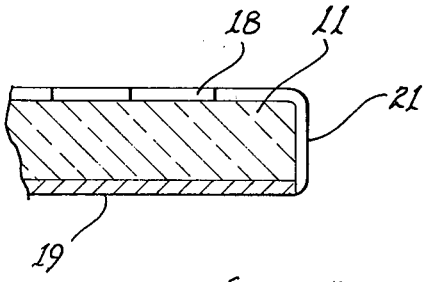
FIG. 2 is an enlarged cross-sectional view taken along the line 2—2 indicated in FIG. 1.

The output line 13 of substrate 11 is terminated via a tapered stub 18. Connecting the output line 13 at junction point 25, stub 18 also connects to, or is integral with, a wraparound shunt 21 which folds around the edge of substrate 11, as shown in FIG. 2, and connects to the ground plane 19 at the lower surface of substrate 11. Tapered stub 18 presents an inductive reactance of known value. The inductive reactance of stub 18 is less dependent on its length and the inductive effect of wrap-around shunt 21 than would conventional fixed characteristic impedance stubs. Further, as will now be shown, the inductive reactance of stub 18 can be readily selected to suit a particular application.

The reactance of stub 18, at junction point 25, is given by equation (1) where:

$$jx = Z_{IN} \quad (3)$$

As can be seen, $jx$ is a function of the frequency (the inverse of the wavelength) and physical length. Since the frequency cannot be adjusted, modifications to $jx$ must be effected by altering the length, $l$ , if it is assumed $Z_{ON}$ is a constant. However, with the tapered stub $Z_{ON}$ can be varied generally between 5 ohms $< Z_{ON} <$ 120 ohms for practical transmission lines. If tapered stub 18 is given a stepped configuration, in which a plurality of conductive segments are arranged in stepped array, the overall impedance, $Z_{IN}$ of stub 18 becomes a composite function of the separate impedances of each step. Since the impedance of each step is a function of its length, $l$, and its width, $w$, which may be individually varied, the impedance of each step, and hence of stub 18, may be selected by appropriate adjustments in the dimensions of the individual steps.

To produce the stepped configuration of stub 18 shown in FIG. 1, equation (1) is utilized to determine the reactance contribution of each step. By well-known iteration techniques and by mathematically combining the individual impedances of the steps, the geometry of stub 18 required to produce the desired overall impedance, $Z_{IN}$, of stub 18 can be determined. Since it is easier to define the T junction for narrow, high impedance transmission lines, the step connecting to transmission line 13 should be the narrowest step of stub 18.

Stub 18 comprises a stepped taper with step 18*a*, the narrowest step, closest to line 13 and step 18*j*, widest step, at the edge of substrate 11. The length *lj*, and width, *wj*, of step 18*j* are indicated in FIG. 1 and are typical. Although the length of each step may be independent of the length of any other step, in most applications the length of the steps will be uniform. Similarly, although the width of each step is independently determined, a uniform differential in width between adjacent steps will generally be utilized. The width of stub 18 is thus incrementally increased in a series of steps from the line 13 to the edge of the substrate 11.

Since step 18*j* connects directly to the ground plane 19 via wrap-around shunt 21, equation (2) applies at step 18*j* and a reduction of $Z_O$ produces a resulting reduction in $Z_{IN}$. It should be noted that shunt 21 is effectively a step of tapered stub 18. The length of shunt 21 is equal to the thickness of substrate 11. The inductive reactance associated with shunt 21 may be reduced by increasing the width, *wj*, or step 18*j*. Also, since the impedance is lowest at the grounded end of stub 18, the parasitic inductance is reduced by the natural reduction in impedance of the stepped stub 18.

In designing a termination according to the present invention, a specific impedance at the termination input is selected. The flexibility of the invention allows several degrees of freedom in determining the required termination configuration. The number of steps may be selected, recognizing that increasing the number of steps decreases the effect of discontinuities but increases the complexity of the termination. The taper, or change in width of each step, can also be varied to alter the composite impedance of the stub.

For purposes of illustration, it will be assumed that input line 12 and output line 13 each have a 50 ohm impedance. To minimize the capacitive effects of step discontinuity, it will also be assumed that stub 18 has 10 steps of equal length. For desired impedance matching purposes, the reactance, $jx$, of stub 18, is assumed to be $j34$ ohms which yield a median value of approximately 25 ohms for the step impedance. If the total length of stub 18 is 0.279 inches, the length of each step will be 0.0279 inches. For a transmission signal frequency of 2.3 GHz, the impedance of the individual steps of stub 18 are as follows:

| Step | Impedance | Width |
|---|---|---|
| 18a | 50.31 ohms | .0465" |
| 18b | 47.00 ohms | .0525" |
| 18c | 43.00 ohms | .0624" |

-continued

| Step | Impedance | Width |
|---|---|---|
| 18d | 39.01 ohms | .0750" |
| 18e | 32.08 ohms | .1050" |
| 18f | 25.21 ohms | .1515" |
| 18g | 21.00 ohms | .1950" |
| 18h | 18.16 ohms | .2360" |
| 18i | 16.10 ohms | .2750" |
| 18j | 14.07 ohms | .3250" |

The tapered stub of the present invention may be readily adapted for use in a wide range of microstrip and stripline applications. The design flexibility inherent in the present invention allows the users to alter the overall impedance of stub 18 simply by modifying the geometry of the tapered stub. Further, the geometry of the stub can be altered to meet physical requirements while maintaining desired electrical properties. For example, the total length of a tapered stub is not constrained since the angle of taper, or difference in width between adjacent step segments, can be adjusted while holding the reactance of the stub constant.

A particular configuration for a particular application has been described. It should be apparent to one skilled in the art that other configurations for use in other applications may be designed without departing from the spirit and scope of the present invention. Since the cascading steps of the tapered stub would still each possess their individual characteristic impedances, permitting ready selection of the composite reactance for stub 18. Similarly, although stub 18 is described as having ten discrete steps, it should be apparent that any desired number of steps can be utilized.

What is claimed is:

1. A transmission system comprising:

a transmission line formed on an insulating substrate;

a conductive layer terminating stub connected to said transmission line for terminating said transmission line and having a predetermined width at a point of connection to said transmission line, said stub having a progressively and incrementally increasing width as the distance from said transmission line increases, a ground plane also formed on the insulating substrate, and a conductive layer shunt connected to said stub and to said ground plane to terminate said transmission line in a d.c. short circuit ground.

2. A transmission system in accordance with claim 1 wherein the progressively increasing width of said terminating stub forms a continuously tapering outline consisting of a plurality of individual steps extending from its minimum width at the point of connection with said transmission line.

3. A transmission system in accordance with claim 1 wherein the progressively increasing width of said terminating stub forms a stepped outline having its narrowest step at the point of connection with said transmission line and having progressively wider steps as the distance from said transmission line increases.

4. A transmission system in accordance with claim 3 wherein said transmission line is a microstrip.

5. A transmission system in accordance with claim 3 wherein said transmission line is a stripline.

6. In a microstrip system having a microstrip transmission line formed on one side of an insulating substrate, and having a ground plane formed on an opposite side of said substrate, an improved structure for terminating said microstrip transmission line, comprising:

a conductive layer terminating stub connected to said microstrip transmission line and extending to and including a conductive layer shunt connected to said ground plane, said stub having a given width at a point of connection to said microstrip transmission line and having a progressively stepped and increasing width as the distance from said microstrip transmission line increases and having its maximum width at a point of connection to said shunt.

7. The improved structure of claim 6 wherein the progressively increasing width of said terminating stub forms a continuously tapering outline extending from its minimum width at said microstrip transmission line to its maximum width at said ground plane.

8. The improved structure of claim 6 wherein the progressively increasing width of said terminating stub forms a stepped outline having its narrowest step at the point of connection with said microstrip transmission line and having progressively wider steps as the distance from said microstrip transmission line increases.

9. The method of terminating a microstrip transmission line comprising the steps of:

connecting a conductive layer stub to said microstrip transmission line;

progressively and incrementally increasing the width of said stub as the distance from said microstrip transmission line increases; and connecting the widest portion of said stub to a ground plane.

10. The method of terminating a microstrip transmission line comprising the steps of:

connecting a conductive layer stub to said microstrip transmission line;

progressively increasing the width of said stub in a plurality of steps, as the distance from said microstrip transmission line increases to form a plurality of conductive segments arranged in a stepped array; and connecting the widest step of said stub to a ground plane.

11. In a microstrip transmission line formed on an insulating substrate, an improved structure for terminating said microstrip transmission line in a short circuit termination in the ground plane comprising:

a conductive layer terminating stub connected to said microstrip transmission line and extending to and including a conductive layer shunt connected to said ground plane, said stub having a given width at a point of connection to said microstrip transmission line and having a progressively incrementally stepped and increasing width as the distance from said microstrip transmission line increasing and having its maximum width at a point of connection to said shunt.

12. In a stripline transmission line formed on an insulating substrate, an improved structure for terminating said stripline transmission line in a short circuit termination in the ground plane comprising:

a conductive layer terminating stub connected to said stripline transmission line and extending to and connected to said ground plane, said stub having a given width at a point of connection to said stripline transmission line and having a progressively incrementally stepped and increasing width as the distance from said stripline transmission line increases and having its maximum width at a point of connection to said ground plane.

* * * * *